US007118296B2

(12) United States Patent
Itoh

(10) Patent No.: US 7,118,296 B2
(45) Date of Patent: Oct. 10, 2006

(54) PHOTOSENSITIVE MATERIAL PROCESSOR

(75) Inventor: Koji Itoh, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 111 days.

(21) Appl. No.: 10/885,010

(22) Filed: Jul. 7, 2004

(65) Prior Publication Data

US 2005/0008361 A1 Jan. 13, 2005

(30) Foreign Application Priority Data

Jul. 8, 2003 (JP) ..... 2003-193742

(51) Int. Cl.
*G03D 3/08* (2006.01)

(52) U.S. Cl. ..... 396/612; 396/617; 396/620; 355/27

(58) Field of Classification Search ..... None
See application file for complete search history.

(56) References Cited

U.S. PATENT DOCUMENTS 5,313,242 A 5/1994 Devaney, Jr. et al. ..... 396/622
6,513,539 B1 2/2003 Tanaka ..... 134/648

FOREIGN PATENT DOCUMENTS

JP 06-067393 A 3/1994
JP 06-130617 A 5/1994
JP 07-234488 A 9/1995

*Primary Examiner*—D. Rutledge
(74) *Attorney, Agent, or Firm*—Birch, Stewart, Kolasch & Birch, LLP

(57) ABSTRACT

A photographic paper processor includes plural liquid baths for containing liquid. The liquid baths have partition panels, and are adjacent to one another therewith. An opening formed in the partition panels has first and second inner surfaces opposed to one another. A submerged squeezing blade has a support end and a free end. The support end is secured to the first inner surface. The free end contacts the second inner surface, closes the opening in an openable manner, allows the photographic paper to pass through the opening, and blocks a flow of the liquid through the opening. The submerged squeezing blade is produced from metal having chemical resistance. Furthermore, a contact pressure changing cam increases a contact pressure of the free end on the second inner surface when the submerged squeezing blade closes the opening without passage of the photographic paper.

20 Claims, 8 Drawing Sheets

PHOTOSENSITIVE MATERIAL PROCESSOR

BACKGROUND OF THE INVENTION

This Nonprovisional application claims priority under 35 U.S.C. § 119(a) on Patent Application No(s). 2003-193742 filed in Japan on Jul. 8, 2003, the entire contents of which are hereby incorporated by reference.

1. Field of the Invention

The present invention relates to a photosensitive material processor. More particularly, the present invention relates to a photosensitive material processor in which liquids between liquid baths can be prevented from leaking in a simple manner without raising resistance to transport of the photosensitive material.

2. Description Related to the Prior Art

A printer/processor for photographic printing and photosensitive material processing is known as an automatic photo finishing machine installed in a photo laboratory. The printer/processor includes a printer component and a processor component. The printer component takes an exposure to print an image to photosensitive material such as photographic paper. The processor component consists of a photosensitive material processor, which processes the photographic paper being exposed. There is a drier disposed downstream from the photosensitive material processor, for drying the photographic paper being processed. The photosensitive material processor includes a plurality of liquid baths, which are arranged serially, contain respectively liquids for color development, bleach/fixing, water washing and stabilization. The photographic paper is transported and passed through the liquids in the liquid baths, and photographically processed.

In a well-known and widely used type of the liquid baths, a crossover structure is used, in which a portion of the photographic paper exits from a first one of the liquid baths, passes in the atmosphere, and then enters a second one of the liquid baths adjacent to the first. One alternative technique is a submerged squeezing device for the purpose of shortening a path length for the photographic paper to reduce the process time and raise total efficiency. Examples of this are disclosed in JP-A 6-067393, JP-A 6-130617, JP-A 7-234488, and U.S. Pat. No. 6,513,539 (corresponding to JP-A 2002-055422). A submerged squeezing blade for sealing is included in the submerged squeezing device. A passage opening in each partition panel between the liquid baths has an inner surface, on which a free end of the submerged squeezing blade is contacted with high elasticity. The photographic paper is transported through the submerged squeezing device, which is effective in blocking passage of the liquid even while passage of the photographic paper is allowed.

The submerged squeezing blade in the submerged squeezing device according to the prior art is produced from polyurethane. However, a shortcoming of polyurethane is remarkable in the low chemical resistance. If the submerged squeezing device is used in the panel between the developing bath and the bleach/fixing bath, there occurs failure in the squeezing operation without using silicone rubber as material to produce the submerged squeezing blade, because the silicone rubber has sufficiently high chemical resistance. There remains a problem in the use of the silicone rubber, which has low resiliency. The contact pressure of the free end of the submerged squeezing blade of the silicone rubber in contact with the inside of the passage opening is remarkably small, and cannot be raised adequately. Leakage of liquid is very likely to occur between the liquid baths.

In relation to the developing bath and bleach/fixing bath, a tolerable amount of expected leaked liquid is generally determined as very small, for example 0.06 ml/m$^2$ or less per unit area of the surface of the photographic paper to be transported. Thus, the submerged squeezing device to be used between the developing bath and bleach/fixing bath must operate very reliably for blocking leakage. If the contact pressure between the submerged squeezing blade and the inside of the passage opening is raised to suppress the leakage, another problem may occur in failure of the transport of the photographic paper, because of excessively raised load applied to the photographic paper being transported. It is extremely difficult to obtain sealing properties for blocking the liquids, and at the same time smoothness in transporting the photographic paper.

SUMMARY OF THE INVENTION

In view of the foregoing problems, an object of the present invention is to provide a photosensitive material processor in which liquids between liquid baths can be prevented from leaking in a simple manner without raising resistance to transport of the photosensitive material.

In order to achieve the above and other objects and advantages of this invention, a photosensitive material processor includes partition panels for keeping separate a plurality of liquid baths disposed adjacent to one another for containing liquid adapted to processing photosensitive material. An opening is formed in the partition panels, and has first and second inner surfaces opposed to one another. A submerged squeezing blade has a support end and a free end, for closing the opening in an openable manner, the support end being secured tightly to a portion of the first inner surface, the free end contacting the second inner surface, for allowing the photosensitive material to pass through the opening upon pressing open of the photosensitive material to the free end, and for blocking a flow of the liquid through the opening. The submerged squeezing blade is produced from metal having chemical resistance.

The free end is positioned downstream from the support end. At least one of the second inner surface and the submerged squeezing blade is tilted in a direction to increase a distance between the second inner surface and the submerged squeezing blade in an upstream direction.

The liquid is different between the plural liquid baths.

The metal is a selected one of stainless steel, titanium, and nickel-base alloy.

Furthermore, a contact pressure changer increases a contact pressure of the free end on the second inner surface when the submerged squeezing blade closes the opening without passage of the photosensitive material.

The contact pressure changer is shiftable between first and second positions, and when in the first position, presses the free end against the second inner surface, and when in the second position, sets lower the contact pressure applied by the free end to the second inner surface than when in the first position.

The contact pressure changer includes a contact pressure changing cam, having an axial shaft and a cam surface, the axial shaft being supported on a lateral panel of the opening in a rotatable manner, the cam surface being opposed to the free end, for pressing the free end.

The contact pressure changer includes a contact pressure changing lever or connecting support, having first and second ends, the first end being secured to the first inner surface in a pivotally movable manner, the second end being secured to the support end.

In one preferred embodiment, furthermore, a connector connects the submerged squeezing blade with the first inner surface by sandwiching of the submerged squeezing blade. A guiding surface on the connector is opposed to the second inner surface, and tilted in a direction to increase a distance to the second inner surface with respect to the upstream direction.

In another preferred embodiment, the submerged squeezing blade further includes a coating applied to a surface thereof.

The plural liquid baths include two liquid baths adjacent substantially vertically to one another. Furthermore, a transporting mechanism transports the photosensitive material in an upward or downward direction through the opening.

In one preferred embodiment, the plural liquid baths include two liquid baths adjacent substantially horizontally to one another. Furthermore, a transporting mechanism transports the photosensitive material horizontally through the opening.

The plural liquid baths include a developing bath and a bleaching bath in which the liquid is respectively developing liquid and bleaching liquid.

The plural liquid baths include a bleaching bath and a fixing bath in which the liquid is respectively bleaching liquid and fixing liquid.

The plural liquid baths include a fixing bath and a water washing bath in which the liquid is respectively fixing liquid and water.

In one aspect of the invention, a photosensitive material processor includes plural liquid baths for containing liquid adapted to processing photosensitive material, the liquid baths having partition panels, and being disposed adjacent to one another therewith. An opening is formed in the partition panels, and has first and second inner surfaces opposed to one another. A submerged squeezing blade, has a support end and a free end, the support end being secured to the first inner surface, the free end contacting the second inner surface, for closing the opening in an openable manner, for allowing the photosensitive material to pass through the opening, and for blocking a flow of the liquid through the opening. A contact pressure changer increases a contact pressure of the free end on the second inner surface when the submerged squeezing blade closes the opening without passage of the photosensitive material.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
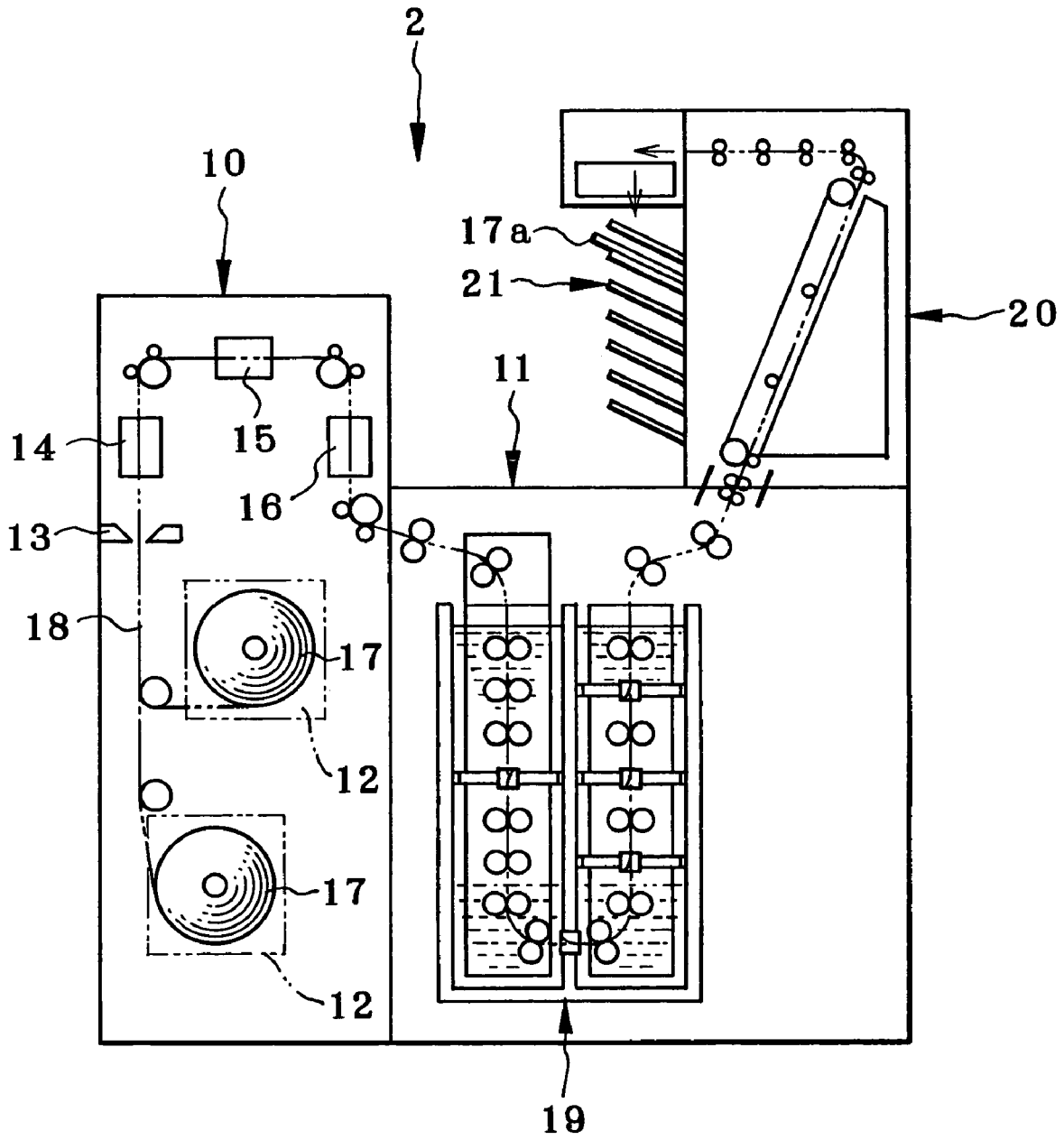
FIG. 1 is an explanatory view in section, illustrating a printer/processor.

In FIG. 1, a printer/processor 2 for photographic printing and photosensitive material processing is illustrated, and includes a printer component 10 and a processor component 11 constructed according to the present invention. The printer component 10 is loaded with a magazine 12, and includes a cutter 13, a back imprinting unit 14, an image forming unit 15 of exposure, and an advancing/sorting mechanism 16. A roll of photographic paper 17 as photosensitive material is set in the magazine 12, cut by the cutter 13 in a predetermined printing size into photographic paper sheets 17*a*.

There is a transporting path 18 as indicated by the phantom line. The paper sheets 17*a* are transported through the transporting path 18 toward the image forming unit 15. In the transporting path 18, the back imprinting unit 14 imprints information to a back surface of the paper sheets 17*a*, the information including a frame number, correction information, and the like. Then an image is printed to an emulsion surface of the paper sheets 17*a* by exposure at the image forming unit 15 according to image data. The plural paper sheets 17*a* are sorted into two trains by the advancing/sorting mechanism 16, and advanced to the processor component 11 in an orientation with its emulsion surface directed up and with its support directed down.

The processor component 11 includes a photosensitive material processor 19 or multi-bath unit, a drier 20, and a sorter 21. The drier 20 is constituted by a heater, a duct, and a fan or blower, and dries the paper sheets 17*a* after the development. The sorter 21 sorts the numerous paper sheets 17*a* according to customer orders for printing, and stacks in sheet stacks. Note that it is possible to transport the photographic paper 17 of a continuous form to those units continuously. The photographic paper 17 can be dried in the drier 20, and then cut into paper sheets frame by frame.

Figure 2:
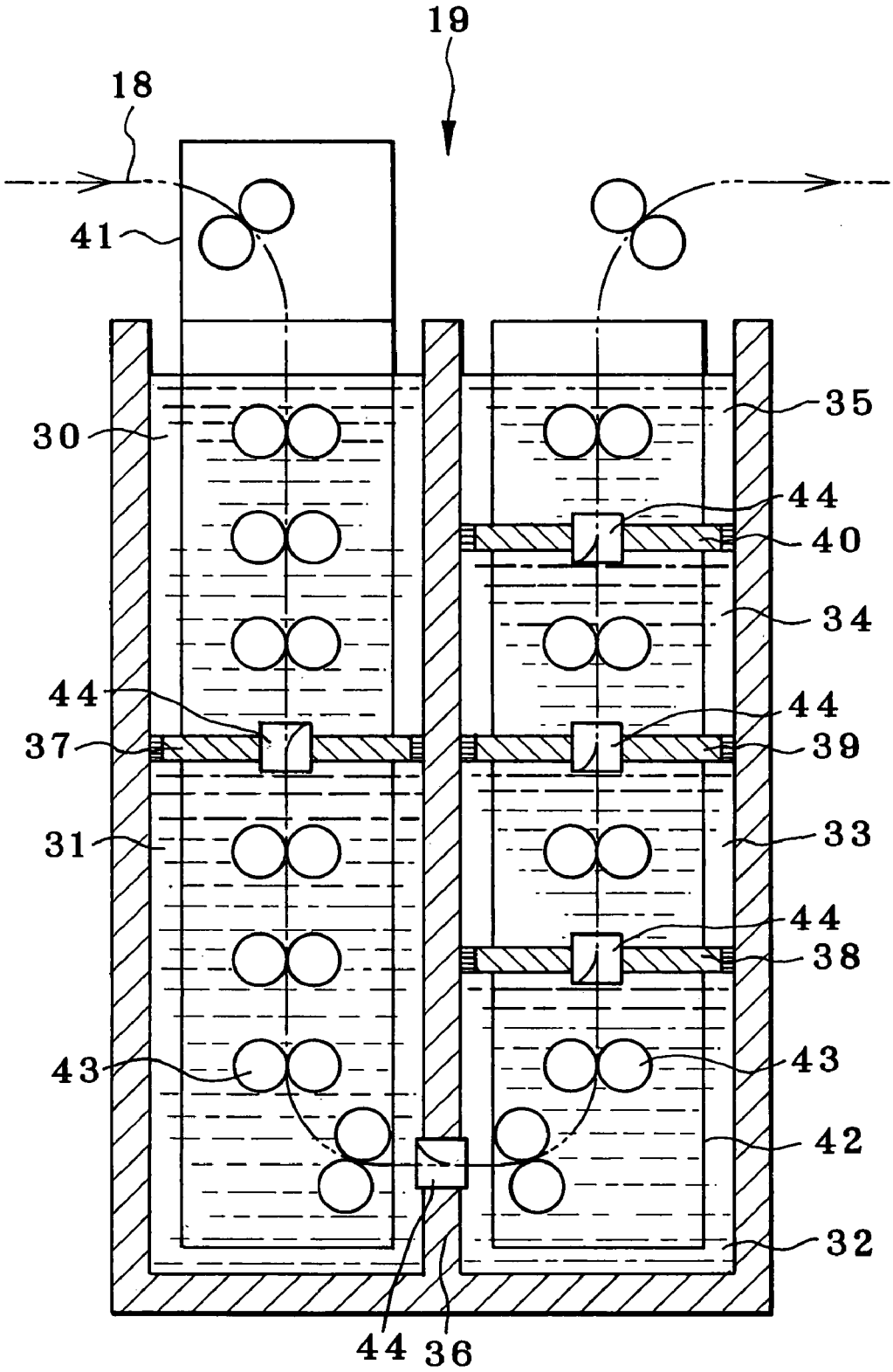
FIG. 2 is an explanatory view in section, illustrating a photosensitive material processor of the invention.

In FIG. 2, the photosensitive material processor 19 is a multi-bath unit, and includes a developing bath 30, a bleach/fixing bath 31, and water washing baths 32, 33, 34 and 35 as liquid baths arranged in series in a downstream direction on the transporting path 18. The developing bath 30 contains developing liquid or solution. The bleach/fixing bath 31 contains bleach/fixing liquid or solution. Each of the water washing baths 32–35 contains water for washing. Any one of those has a predetermined volume. There is a vertical partition panel 36 extending vertically for partitioning between a group of the developing bath 30 and the bleach/fixing bath 31 and a group of the water washing baths 32–35. Horizontal partition panels 37, 38, 39 and 40 extend horizontally for partitioning of the baths adjacent on the transporting path 18.

Transporting racks 41 and 42 are disposed in the developing bath 30, the bleach/fixing bath 31, and the water washing baths 32–35 in a removable manner. Transporting rollers 43 are included in the transporting racks 41 and 42, and transport the paper sheets 17*a* in a submerged state in the liquid baths. There is a replenishing water tank (not shown) containing water for washing, with which the water washing bath 35 is supplied by a pump. The replenishing water flows down from the water washing bath 35 toward the water washing bath 32. The water washing bath 32 is provided with an overflow drain or pipe.

Figure 3:
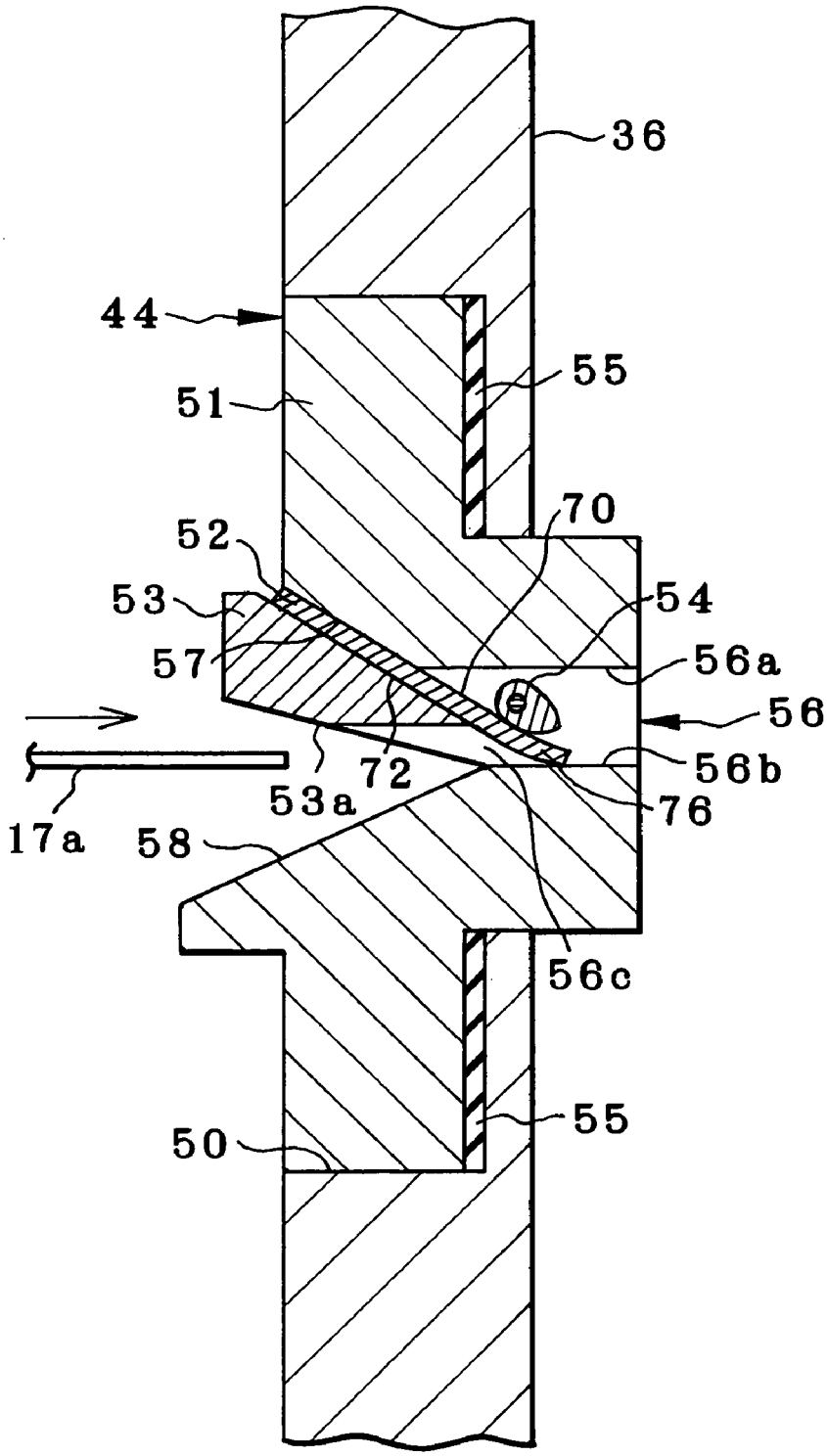
FIG. 3 is a cross section, partially broken, illustrating a submerged squeezing device.

A submerged squeezing device 44 or anti-leak device is incorporated in each of the partition panels 36–40, and blocks passage of the contained liquid, and also allows passage of the paper sheets 17*a*. In FIG. 3, an attaching opening 50 is formed in the vertical partition panel 36 or any one of the horizontal partition panels 37–40. A blade frame 51 of the submerged squeezing device 44 is fixedly fitted in the attaching opening 50. Also, the submerged squeezing device 44 having the blade frame 51 includes a submerged squeezing blade 52 or anti-leak blade, a connecting board or connecting support 53 and a contact pressure changing cam 54.

The blade frame 51 is secured to the vertical partition panel 36 with screws or other fastening elements, and can be removed when the screws are unfastened. A packing 55 is sandwiched between the blade frame 51 and the vertical partition panel 36. Note that the blade frame 51 may be included in the vertical partition panel 36 as one piece. This makes it possible unnecessary to insert the packing 55.

A passage opening 56 is formed in the center of the blade frame 51, and extends in the width direction of the paper sheets 17*a*. Portions of the blade frame 51 defining the passage opening 56 include a first inner surface 56*a*, a second inner surface 56*b* and a lateral panel 56*c*.

An upstream end of portions of the passage opening 56 is chamfered with a tilted shape. A connecting surface 57 as first inner surface extends upstream from the first inner surface 56*a*, and has an inclination. There is a guiding surface 58 as second inner surface, which extends upstream from the second inner surface 56*b*, and guides an end of the paper sheets 17*a*. The submerged squeezing blade 52 is secured to the connecting surface 57 with the connecting support 53 by use of screws or suitable fastening elements.

The submerged squeezing blade 52 is produced from metal having resistance to chemical material. Examples of the metal of a plate for the submerged squeezing blade 52 include stainless steel, titanium, and nickel-base alloy, such as Hastelloy (trade name), Inconel (trade name) and the like. In a normal state, a squeezing surface 72 of the submerged squeezing blade 52 at its free end 76 contacts the second inner surface 56*b* of the passage opening 56 with elasticity. So the passage opening 56 is closed by the submerged squeezing blade 52. Also, while the paper sheet 17*a* passes, a leading end of the paper sheet 17*a* pushes away the free end 76 of the submerged squeezing blade 52. The paper sheet 17*a* is allowed to pass in the submerged squeezing device 44. At the same time, the liquid is prevented from passing by the submerged squeezing blade 52.

The connecting support 53 is formed in a wedge shape of which a width decreases toward its end. A guiding surface 53*a* of the connecting support 53 has a form to guide the leading end of the paper sheet 17*a* while the submerged squeezing blade 52 is secured to the blade frame 51. The guiding surfaces 53*a* and 58 have such shapes that an interval between those increases in an upstream direction according to the transport of the paper sheet 17*a*. It is to be noted that, although only the vertical partition panel 36 has been described heretofore in detail, the horizontal partition panels 37–40 are structurally the same as the vertical partition panel 36.

Figure 4A:
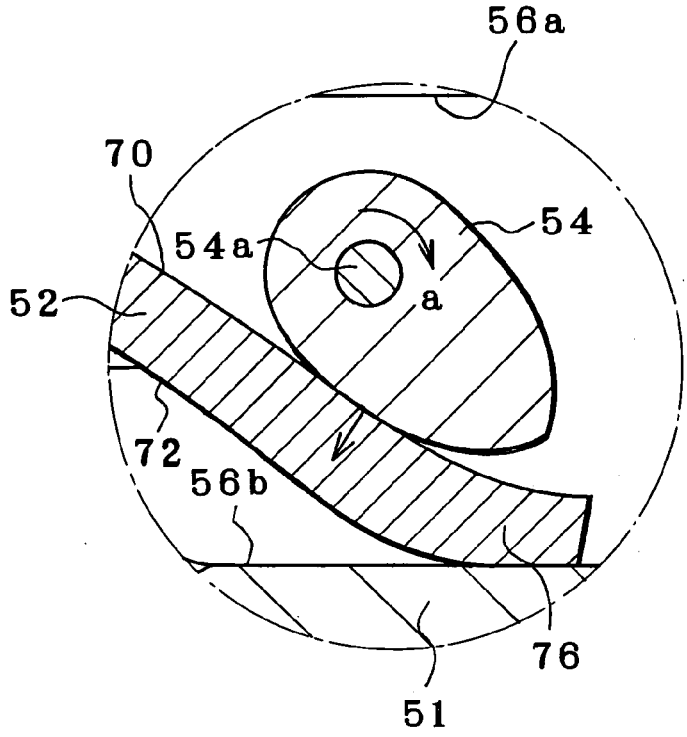
FIG. 4A is a cross section illustrating a contact pressure changing cam.
Figure 4B:
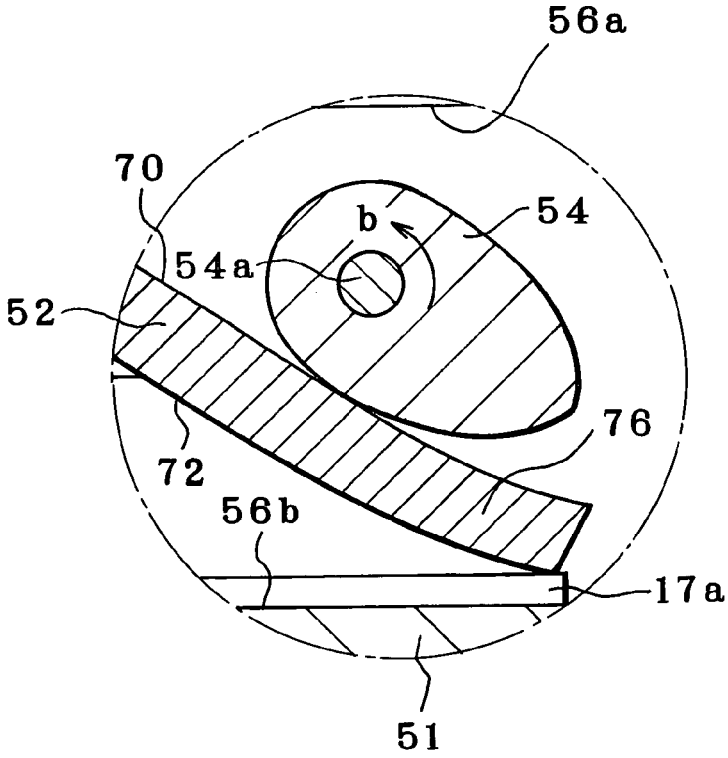
FIG. 4B is a cross section illustrating the same as FIG. 4A but in a state to allow passage of paper.

There is an axial shaft 54*a* about which the contact pressure changing cam 54 rotates. In FIG. 4A, the paper sheet 17*a* does not pass the submerged squeezing device 44. The contact pressure changing cam 54 is rotationally shifted in the clockwise direction a of the arrow about the axial shaft 54*a*, to press the end of the submerged squeezing blade 52 against the second inner surface 56*b* of the passage opening 56. A contact pressure between the free end 76 of the submerged squeezing blade 52 and the second inner surface 56*b* of the passage opening 56 is kept high. In FIG. 4B, the paper sheet 17*a* passes the submerged squeezing device 44. The contact pressure changing cam 54 is rotationally shifted in the counterclockwise direction b of the arrow. A back surface 70 of the submerged squeezing blade 52 is released, to allow the free end 76 to move away from the second inner surface 56*b*. To control the driving of the contact pressure changing cam 54, various methods can be used. For example, a passage sensor is disposed close to an entrance gate of the photosensitive material processor 19 for the paper sheet 17*a* in order to detect existence or lack of passage of the paper sheet 17*a*. Information of detection of the sensor and a given value of processing time are combined, to control the driving of the contact pressure changing cam 54. It is to be noted that the pressure applied to the free end 76 of the submerged squeezing blade 52 is safely kept within a range of limit of elasticity of the submerged squeezing blade 52.

The operation of the above construction is described now. A command signal for printing is input. In response, the photographic paper 17 is unwound and advanced from the magazine 12. The cutter 13 cuts the paper sheet 17*a* from the photographic paper 17. Then the back imprinting unit 14 prints information to the paper sheet 17*a*, the information including a frame number and correction information. The image forming unit 15 effects an exposure, and prints an image to the emulsion surface of the paper sheet 17*a* according to image data. After this, the advancing/sorting mechanism 16 sorts the paper sheet 17*a* and directs it to one of two parallel paths that extend into the processor component 11.

The paper sheet 17*a* is transported by the transporting rollers 43 and the submerged squeezing device 44 serially through the developing bath 30, the bleach/fixing bath 31 and the water washing baths 32–35, and is subjected to processing, bleach/fixing and washing with water. While the paper sheet 17*a* is not disposed through the submerged squeezing device 44, the contact pressure changing cam 54 rotates in the clockwise direction a of the arrow as viewed in FIG. 4A. The squeezing surface 72 of the free end 76 of the submerged squeezing blade 52 is pressed against the second inner surface 56*b* of the passage opening 56. This raises the contact pressure between the submerged squeezing blade 52 and the second inner surface 56*b* of the passage opening 56.

For the time of passage of the paper sheet 17*a* through the submerged squeezing device 44, the contact pressure changing cam 54 is rotationally shifted in the counterclockwise direction of the arrow b in FIG. 4B. The free end 76 of the submerged squeezing blade 52 is released from the pressure. The paper sheet 17*a* after the development is dried by the drier 20, and sorted and stacked by the sorter 21 for groups according to the customer orders for printing.

A conventionally used structure for the same purpose has been a crossover structure, which is involved with problem of contamination of transporting rollers. However, in contrast with this, it is possible according to the above construction to facilitate maintenance and long use of the apparatus of the processor, because contamination will not be stuck on the transport rollers even upon condensation or crystallization of the developing solution. Furthermore, leakage of the liquid is suppressed or minimized while the paper sheet 17*a* does not exist in the submerged squeezing device 44. There is no rise in the load of the transport even during passage of the paper sheet 17*a* through the submerged squeezing device 44.

In the above embodiment, the submerged squeezing blade 52 for any of the partition panels is produced from metal. However, a single non-metallic material or plural combined material may be used for producing the submerged squeezing blade 52 for suitable manners. For example, the panel between the developing bath 30 and the bleach/fixing bath 31 can have the submerged squeezing device 44 with the submerged squeezing blade 52 of metal for the purpose of high chemical resistance as required. In contrast, each panel between the water washing baths 32–35 can have the submerged squeezing device 44 with the submerged squeezing blade 52 of suitable materials, examples of which include elastomer such as silicone rubber and polyurethane foam, and the like, and also include combined materials having a support of metal and an elastomer layer applied thereto. It is, however, to be noted that the submerged squeezing blade 52 of metal should be used in the submerged squeezing device 44 for the water washing baths 32–35 typically because this is effective in the structure where the water washing baths 32–35 are arranged directly vertically one another.

For the submerged squeezing blade 52, it is possible to use resin having resistance to chemical material. Examples of such resins include polyether imides, polyether sulfones, polysulfone, polyether ether ketones, and polyphenylene sulfides. It is necessary to consider deformation of the blade with creep upon pressing of the free end 76 on the inner surface of the opening.

Figure 5:
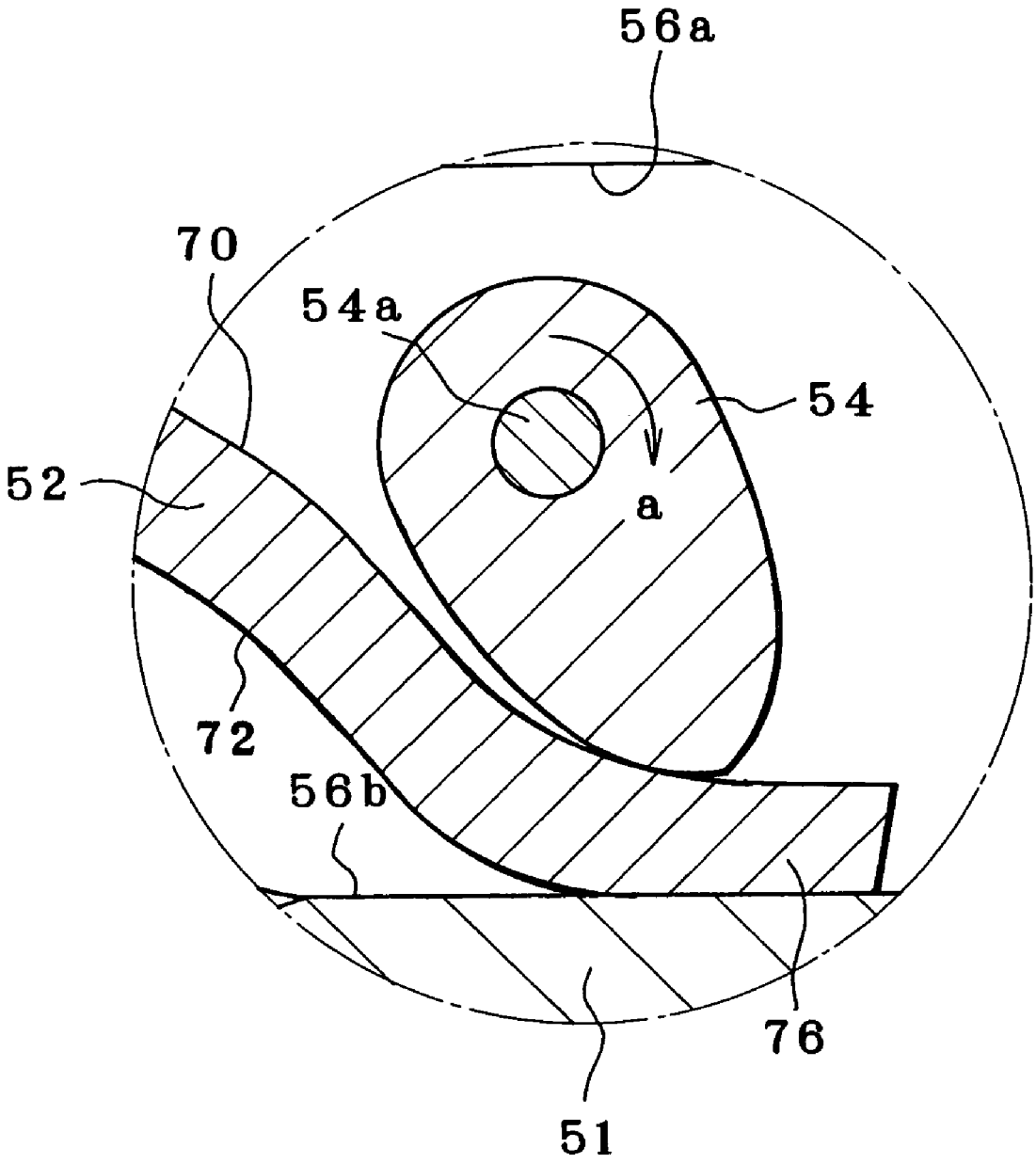
FIG. 5 is a cross section illustrating the contact pressure changing cam in a state of maximized pressure.

FIG. 5 illustrates a state of the contact pressure changing cam 54 rotationally shifted further from the state of FIG. 4A in the clockwise direction a. The end of the submerged squeezing blade 52 is caused to contact the second inner surface 56*b* of the passage opening 56 with a larger area and greater pressure. However, the state of FIG. 5 is a partial modification of the embodiment. If the state of FIG. 5 is used, it is preferable to produce the submerged squeezing blade 52 from the afore-mentioned combined materials having a support of metal and an elastomer layer applied thereto.

Figure 6:
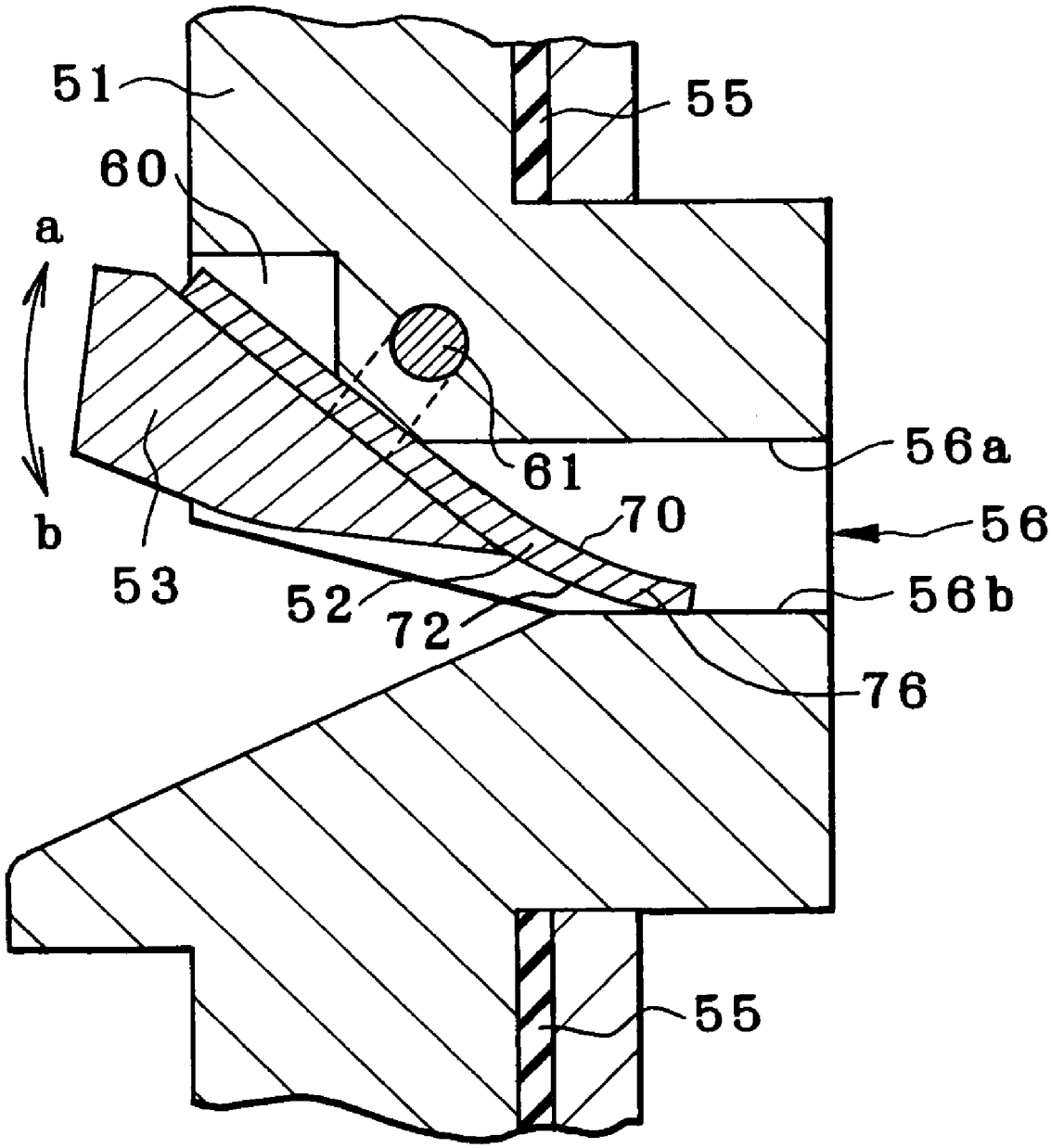
FIG. 6 is a cross section, partially broken, illustrating another preferred contact pressure changer.

The contact pressure may be changed by a different structure from the contact pressure changing cam 54. In FIG. 6, another preferred embodiment is illustrated. A rotatable contact pressure changing lever 61 keeps the connecting support 53 rotatable in a clockwise direction of the arrow a and a counterclockwise direction of the arrow b within a limited range for the same purpose as the contact pressure changing cam 54. A cutout 60 is formed in the blade frame 51 as a space for a path of the contact pressure changing lever 61. If the paper sheet 17*a* does not exist in the submerged squeezing device 44, the connecting support 53 is rotated about an axis by the contact pressure changing lever 61 in the clockwise direction of the arrow a, to press the free end 76 of the submerged squeezing blade 52 on the second inner surface 56*b* of the passage opening 56. This is effective in raising the pressure between the submerged squeezing blade 52 and the second inner surface 56*b*. Also, in passage of the paper sheet 17*a* through the submerged squeezing device 44, the connecting support 53 is rotated in the counterclockwise direction of the arrow b, to release the free end 76 of the submerged squeezing blade 52 from being pressed.

Furthermore, it is possible to dispose an air bag at an upper portion of the free end 76 of the submerged squeezing blade 52, namely in place of the contact pressure changing cam 54. The air bag can be extensible according to entry and exhaust of air or other suitable fluid. If the paper sheet 17*a* is not passed through the submerged squeezing device 44, the air bag can be driven and inflated.

In the above embodiment, the developing bath 30 is one bath. The bleach/fixing bath 31 is one bath. The water washing baths 32–35 are four baths. However, the number of liquid baths for each one of development, bleach/fixing and water washing may be different from that of the above embodiment. In the above embodiment, the liquid baths are arranged vertically on one another. However, liquid baths according to the invention may be horizontally arranged on one another.

Figure 7A:
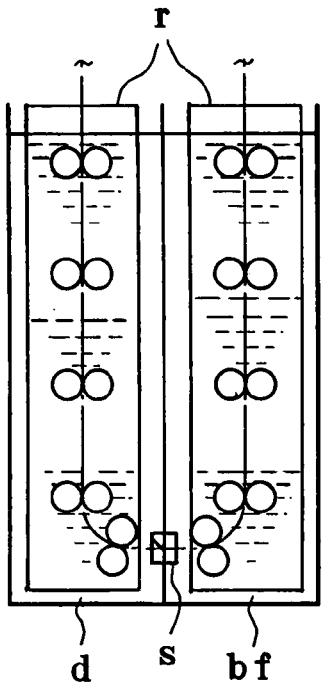
FIG. 7A is an explanatory view in section, illustrating one arrangement of liquid baths.
Figure 7B:
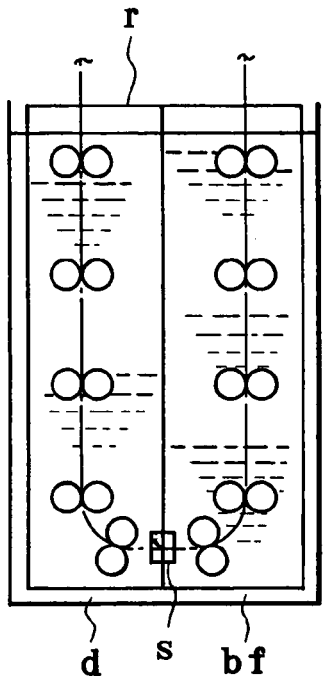
FIG. 7B is an explanatory view in section, illustrating an arrangement of liquid baths where a single transporting rack is used commonly.
Figure 7C:
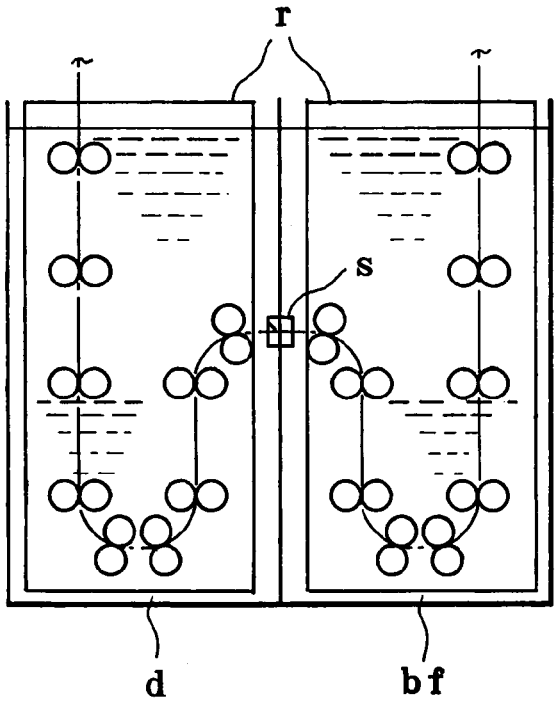
FIG. 7C is an explanatory view in section, illustrating an arrangement of liquid baths where a transporting path is curved.

Various examples of disposition of the liquid baths can be used. In FIG. 7A, the developing bath d and the bleach/fixing bath bf are arranged horizontally with one another. The transporting rack r is incorporated in each of the developing bath d and the bleach/fixing bath bf. In FIG. 7B, the developing bath d and the bleach/fixing bath bf are arranged horizontally with one another. The single transporting rack r is used commonly for both of the developing bath d and the bleach/fixing bath bf, and includes a submerged squeezing device s. In FIG. 7C, a path through the developing bath d and the bleach/fixing bath bf is determined in the U-shape to obtain a great path length with ease. The transporting rack r is disposed for each of the developing bath d and the bleach/fixing bath bf.

Figure 8A:
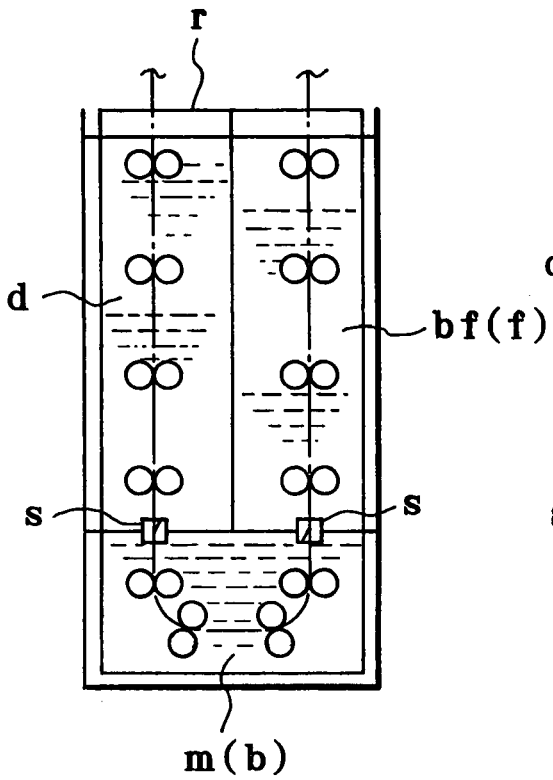
FIGS. 8A and 8B are explanatory views in section, illustrating arrangements of liquid baths arranged horizontally and vertically in combination.
Figure 8B:
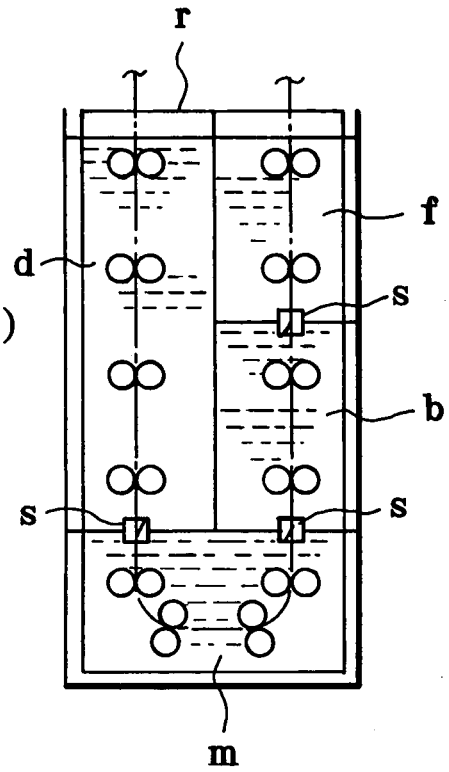
Figure 8C:
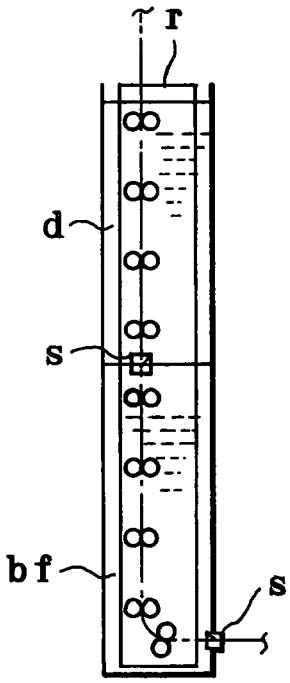
FIG. 8C is an explanatory view in section, illustrating an arrangement of liquid baths arranged vertically.

In FIG. 8A, the intermediate bath m or bleaching bath b is disposed between the developing bath d and any one of the bleach/fixing bath bf and fixing bath f. There is a single transporting rack r in which the submerged squeezing device s is incorporated. In FIG. 8B, the developing bath d, the intermediate bath m, the bleaching bath b and fixing bath f are arranged in a vertical direction. The submerged squeezing device s is incorporated in the single transporting rack r. In FIG. 8C, the bleach/fixing bath bf is disposed directly under the developing bath d. A path length of the developing bath d and bleach/fixing bath bf is determined greater than that according to the above embodiment. The submerged squeezing device s is incorporated in the single transporting rack r. Note that intermediate baths m are disposed in order to reduce contamination in spaces between the liquid baths. Initially, the intermediate baths m are filled with the developing liquid. The liquid in those gradually changes to mixture of the developing liquid and the bleaching liquid or bleach/fixing liquid.

In the above embodiment, the printer/processor 2 is an apparatus of a combined structure having the printer component 10 and the processor component 11. However, a processor according to the invention may be an apparatus separate from a printer component, and supplied with exposed photosensitive material.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A photosensitive material processor comprising:

partition panels for keeping separate a plurality of liquid baths disposed adjacent to one another for containing liquid adapted to processing photosensitive material;

an opening, formed in said partition panels, and having first and second inner surfaces opposed to one another; and a submerged squeezing blade, having a support end and a free end, said free end for pressing to close said opening, said support end being secured tightly to a portion of said first inner surface, said free end contacting said second inner surface, said free end being able to lift to contact said photosensitive material so as to allow passage of said photosensitive material through said opening, and for blocking a flow of said liquid through said opening;

wherein said submerged squeezing blade is produced from metal having chemical resistance.

2. The photosensitive material processor as defined in claim 1, wherein said submerged squeezing blade is tilted in a manner pressable away with a leading end of said photosensitive material.

3. The photosensitive material processor as defined in claim 2, wherein said liquid is different between said plural liquid baths.

4. The photosensitive material processor as defined in claim 3, wherein said metal is a selected one of stainless steel, titanium or nickel-base alloy.

5. The photosensitive material processor as defined in claim 4, further comprising a contact pressure changer for increasing a contact pressure of said free end on said second inner surface before and after passage of said photosensitive material.

6. The photosensitive material processor as defined in claim 5, wherein said contact pressure changer includes a contact pressure changing cam, having an axial shaft and a cam surface, said axial shaft being supported on a lateral panel of said opening in a rotatable manner, said cam surface being opposed to said free end, for pressing said free end.

7. The photosensitive material processor as defined in claim 5, wherein said contact pressure changer includes a pivotally movable connecting support for connecting said support end with said first inner surface, and for rotating to change said contact pressure by changing an inclination of said submerged squeezing blade.

8. The photosensitive material processor as defined in claim 2, wherein said submerged squeezing blade further includes a coating applied to a surface thereof.

9. The photosensitive material processor as defined in claim 2, wherein said plural liquid baths include two liquid baths adjacent substantially vertically to one another;

further comprising a transporting mechanism for transporting said photosensitive material in an upward or downward direction through said opening.

10. The photosensitive material processor as defined in claim 2, wherein said plural liquid baths include two liquid baths adjacent substantially horizontally to one another;

further comprising a transporting mechanism for transporting said photosensitive material horizontally through said opening.

11. The photosensitive material processor as defined in claim 2, wherein said plural liquid baths include a developing bath and a bleaching bath in which said liquid is respectively developing liquid and bleaching liquid.

12. The photosensitive material processor as defined in claim 2, wherein said plural liquid baths include a bleaching bath and a fixing bath in which said liquid is respectively bleaching liquid and fixing liquid.

13. The photosensitive material processor as defined in claim 2, wherein said plural liquid baths include a fixing bath and a water washing bath in which said liquid is respectively fixing liquid and water.

14. A photosensitive material processor comprising:

partition panels for keeping separate a plurality of liquid baths disposed adjacent to one another for containing liquid adapted to processing photosensitive material;

an opening, formed in said partition panels, and having first and second inner surfaces opposed to one another;

a submerged squeezing blade, having a support end and a free end, said free end for pressing to close said opening, said support end being secured tightly to a portion of said first inner surface, said free end contacting said second inner surface, said free end said free end being able to lift to contact said photosensitive material so as to allow passage of said photosensitive material through said opening, and for blocking a flow of said liquid through said opening; and a contact pressure changer for increasing a contact pressure of said free end on said second inner surface before and after passage of said photosensitive material.

15. The photosensitive material processor as defined in claim 14, wherein said free end is tilted.

16. The photosensitive material processor as defined in claim 15, wherein said contact pressure changer includes a contact pressure changing cam, having an axial shaft and a cam surface, said axial shaft being supported on a lateral panel of said opening in a rotatable manner, said cam surface being opposed to said free end, for pressing said free end.

17. The photosensitive material processor as defined in claim 15, wherein said contact pressure changer includes a pivotally movable connecting support for connecting said support end with said first inner surface, and for rotating to change said contact pressure by changing an inclination of said submerged squeezing blade.

18. The photosensitive material processor as defined in claim 15, wherein said plural liquid baths include a developing bath and a bleaching bath in which said liquid is respectively developing liquid and bleaching liquid.

19. The photosensitive material processor as defined in claim 15, wherein said plural liquid baths include a bleaching bath and a fixing bath in which said liquid is respectively bleaching liquid and fixing liquid.

20. The photosensitive material processor as defined in claim 15, wherein said plural liquid baths include a fixing bath and a water washing bath in which said liquid is respectively fixing liquid and water.

* * * * *